US006102013A

United States Patent [19]

Lee

[11] Patent Number: 6,102,013

[45] Date of Patent: Aug. 15, 2000

[54] SUPERCHARGER FOR DIESEL ENGINE

[75] Inventor: Jae Hong Lee, Kyonggi-do, Rep. of Korea

[73] Assignee: Hyundai Motor Company, Seoul, Rep. of Korea

[21] Appl. No.: 09/368,356

[22] Filed: Aug. 5, 1999

[30] Foreign Application Priority Data

Feb. 9, 1999 [KR] Rep. of Korea ..... 99-4351

[51] Int. Cl.[7] ..... F02B 33/40

[52] U.S. Cl. ..... 123/559.1

[58] Field of Search ..... 123/559.1

[56] References Cited

U.S. PATENT DOCUMENTS 1,875,444 9/1932 Hall ..... 123/559.1

5,368,004 11/1994 Mann ..... 123/559.1

FOREIGN PATENT DOCUMENTS 141777 5/1935 Australia ..... 123/559.1

*Primary Examiner*—Michael Koczo

[57] ABSTRACT

A supercharger for an internal combustion, diesel engine includes a clutch disc for engaging or disengaging the flywheel of the engine for transmitting power to the transmission and wheels of a vehicle in which the engine is mounted. A blower assembly for the supercharger is fixedly connected to the clutch disc for rotation in unison therewith. The blower includes a cover secured to the clutch disc and a plurality of impeller vanes disposed about its periphery. In operation, when the clutch disc is engaged with the flywheel of the engine, the blower of the supercharger rotates in unison with the clutch plate to draw in air and supply compressed air to the engine to perform the supercharging functions. However, during idling, when the clutch is disengaged, the supercharger blower does not rotate thereby minimizing fuel consumption.

3 Claims, 2 Drawing Sheets

SUPERCHARGER FOR DIESEL ENGINE

BACKGROUND OF THE INVENTION

The present invention relates to an air suction (supercharging) device for a diesel engine, and more particularly to an air suction (supercharging) device having a novel clutch-coupled blower assembly.

In general, a diesel engine vehicle includes a super charger for compressing by air supplied induced to engine by utilizing the energy of flowing exhaust gas; and an inter-cooler for cooling the air super-charged in order to improve output of the diesel engine.

FIG. 1 shows a suction device of conventional diesel vehicle, with exhaust gas of high temperature and high pressure exhausted through an exhaust manifold 1*b* when an engine 1 is driven, which passes through turbine 2*a* of supercharger 2 provided in an exhaust pipe 1, and rotates the turbine 2*a* at high speed, and then is exhausted through the exhaust pipe 3.

According to this conventional arrangement, when the turbine 2*a* is rotated at high speed, a blower 2*b* which is connected to the same shaft as turbine 2*a*, and provided at a suction inlet 4 side, is also rotated at high speed, and as the blower 2*b* is rotated at high speed, exterior air is sucked through the suction inlet 4 and supplied to an inter-cooler 5 in a state compressed to a high pressure. The air cooled by passing through the inter-cooler 5 is supplied to a combustion chamber through the suction manifold 1*a* of engine 1 whereby used for combustion.

However, in accordance with such a conventional supercharger, since turbine 2*a* is rotated by utilizing the an exhaust pressure of exhaust gas, and the turbine 2*a* and a blower 2*b* are provided in the exhaust suction system, since they are connected by a rotating shaft 2*c* in order to rotate the blower 2*b* and to suck exterior air by rotary power of said turbine 2*a*, and structure of turbine 2*a* and the blower 2*b* is a complicated structure. There has been a problem not only in designing the blower but also in repairing the blower upon damage occurring.

And, since heat transferred to the turbine 2*a* from high temperature exhaust gas is transferred to the blower 2*b* side along with the rotating shaft 2*c* this makes the temperature of air sucked through the suction inlet 4 to be raised whereby the capacity of the inter-cooler 5 for cooling must be larger.

SUMMARY OF THE INVENTION

Therefore, the present invention solves the foregoing problems, and it is an object of the present invention to provide a supercharger (air suction device) for a diesel engine in which the structure of the device is simple and the manufacturing cost is cheap.

Another object of the present invention is to provide a supercharger (air suction device) for a diesel engine of a structure in which an supercharged air is not influenced by an exhaust gas heat, and thereby capacity requirements of an inter-cooler for cooling the supercharged air can be reduced.

It is still another object of the present invention to provide a supercharger (air suction device) for diesel engine in which transmission oil, a clutch disc and the like, are cooled by the supercharged air whereby deterioration of power transferring system parts from overheating can be prevented.

In order to attain, the foregoing above objects, the present invention comprises:

in a device including a diesel engine, a transmission for transmitting driving power to the wheels of a vehicle from the engine in response to the vehicles running state, and a clutch disc for transferring or isolating the power transferred to the transmission from the engine, a transmission housing in which a suction inlet for sucking exterior air is formed at one side, a discharge outlet for discharging the sucked exterior air so as to supply the engine is formed at another side, and a number of power transmitting parts including the transmission and the clutch disc are contained within interior thereof, a blower impeller for discharging high pressure air through the discharge outlet after sucking the exterior air into said transmission housing through the suction inlet upon driving of the engine by engagement of the clutch is fixed to a disc cover so as to rotate together with disc cover made to surround said clutch dic, with the clutch, the clutch rotating only when engaged with a flywheel of the engine from said discharge outlet, and an inter-cooler for supplying air to the engine by cooling the supercharged air cleaned by said air cleaner.

DETAILED DESCRIPTION OF PREFERRED EMBODIMENTS

Figure 1:
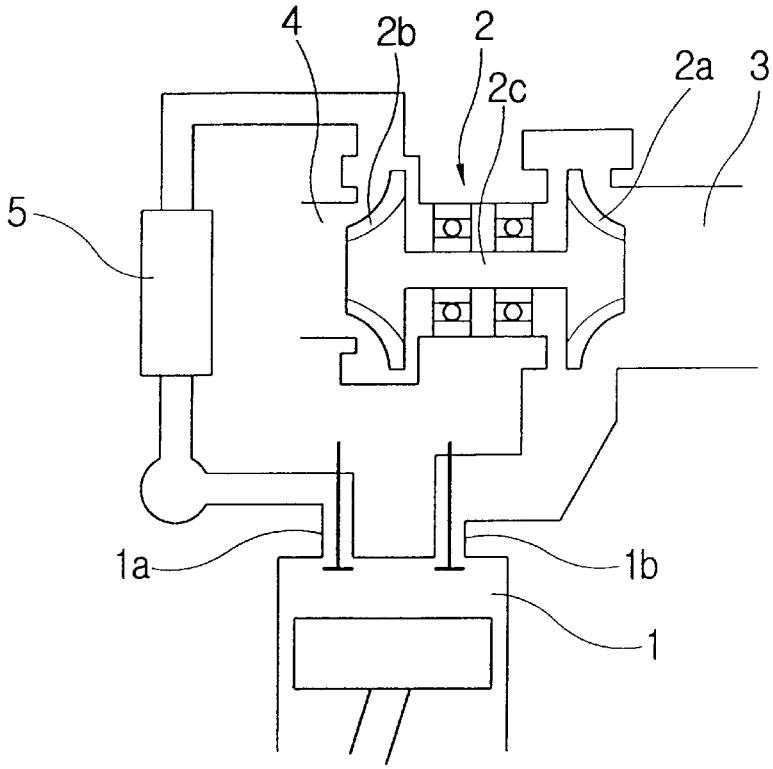
Fig.1 Prior Art
FIG. 1 is a view showing a conventional suction device.
Figure 2:
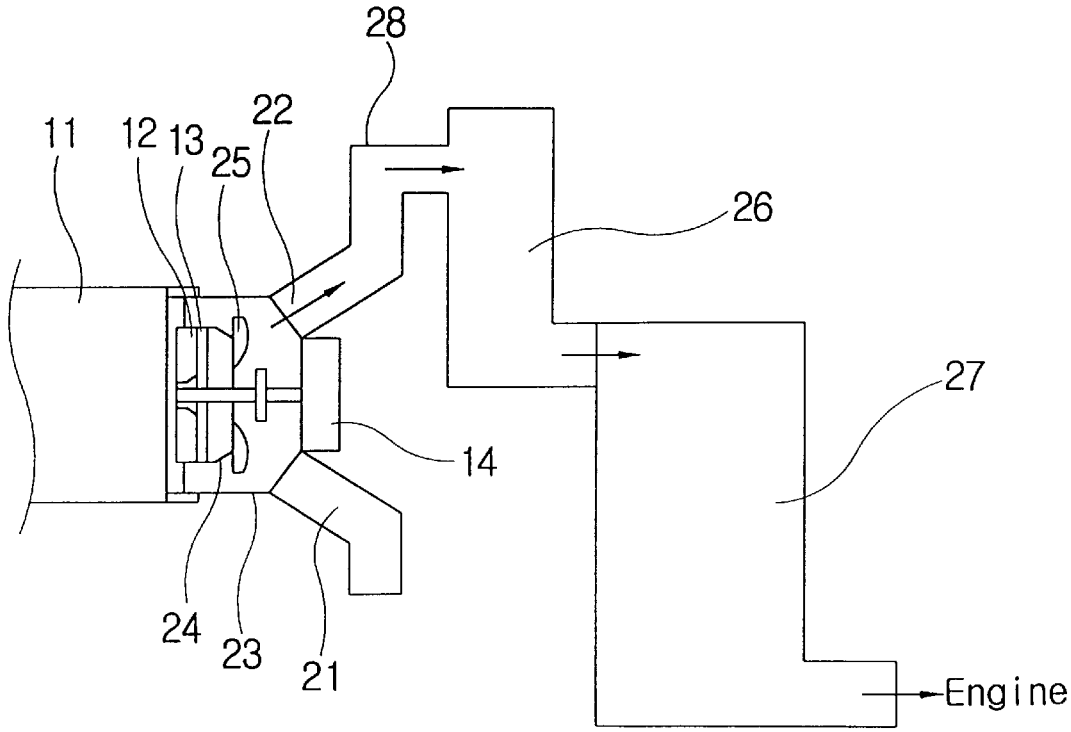
FIG. 2 is a view showing a suction device for diesel engine of the present invention.
Figure 3:
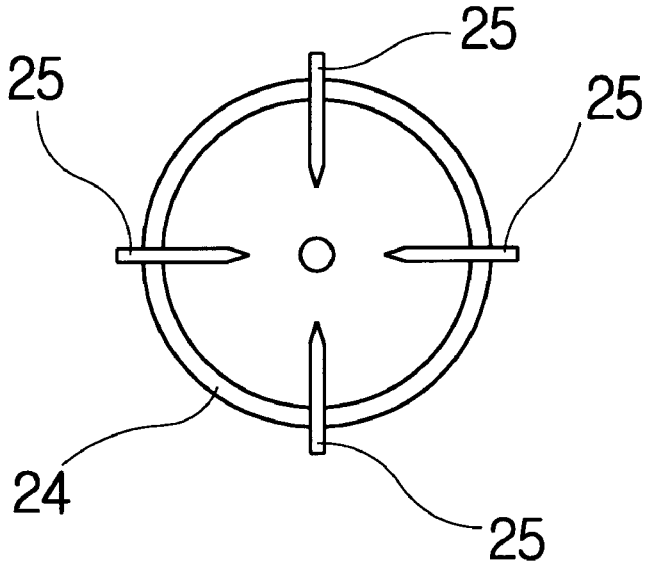
FIG. 3 is a view showing a blower applied to the present invention.

Hereinafter, a preferred embodiment of the present invention will be described more in detail with reference to the accompanying drawings of FIG. 2 and FIG. 3.

According to above drawings, the present invention includes a transmission housing 23, blower 25, air cleaner 26, and inter-cooler 27.

The transmission housing 23 contains a power transmitting parts such as flywheel 12, clutch disc 13, transmission 14, and disc cover 24, and a suction inlet 21 for sucking the air from exterior is included at one side of said transmission housing 23, and a discharge outlet 22 for discharging the sucked air to the engine the side is included at other side thereof.

The discharge outlet 22 is connected through the air cleaner 26 and an air duct 28.

The blower 25 sucks the exterior air into the transmission housing 23 through the suction inlet 21 by rotation and then compresses it whereby the air discharges to the air cleaner 26 through the discharge outlet 22 an impeller of the blower is fixed at one side of the disc cover 24 surrounding the clutch disc 13.

Since the impeller of the blower 25 is fixed to the disc cover 24 and, since the flywheel 12 and disc 13 provided on the driving shaft is rotated at high speed by a rotating force of engine when the engine is driven, the impeller of the blower 25 is also rotated at the same speed as rotating speed of the engine. But when clutch disc 13 is disengaged from flywheel 12, the impeller of blower 25 does not rotate.

Accordingly, at a time when the engine is rotated at high speed, the blower impeller is also rotated at high speed whereby the air supercharged at high pressure is discharged through the discharge outlet 22 and supplied to the engine 11, and at a time when the engine is rotated at low speed, it is rotated at a speed corresponding thereto whereby the air supercharged at relatively low pressure is discharged through the discharge outlet 22 and supplied to the engine 11. However, when idling, the blower's impeller does not rotate.

The air cleaner 26 eliminates foreign material contained within the sucked air, and a filtering element is equipped within the interior thereof.

The inter-cooler 27 is provided between the air cleaner 26 and the engine whereby it cools the cleaned air and supplies it to the suction manifold.

At this moment, a cooling capacity of the inter-cooler 27 can be made to less than a conventional inter-cooler.

Because the air induced from the exterior is induced through the transmission housing 23 in this invention, it is different from conventional systems, since it does not receive any influence of exhaust gas whereby the temperature is not raised so high. Therefore, the cooling capacity of the inter-cooler 27 need not be so high.

Operation and effects of the present invention constructed as above will be described in detail as follows.

When the engine is driven, the disc cover 24 is also rotated at the same speed.

Accordingly, the impeller of the blower 25 formed at one side of the disc cover 24 is also rotated at the same speed as the rotating speed of engine 11 and it sucks the exterior air through the suction inlet 21 formed at one side of the transmission housing 23 and then compresses it, whereby it supplies it to the air cleaner 26 through the discharge outlet 22.

At this moment, the air supplied to the air cleaner 26 is in a supercharged state at high pressure caused by high speed rotation of the blower 25. The sucked air passes through the interior of the transmission housing 23 and cools various power transmitting elements of its interior whereby overheating is prevented.

On the other hand, as described above, the air supplied to the air cleaner 26 is cleansed of foreign materials by passing the elements provided to the air cleaner 26, and it is cooled by passing into inter-cooler 27 whereby air density is increased and then supplied to the engine 11.

In accordance with the present invention operating as above, since the sucked air passes through the transmission housing 23 and the temperature of sucked air is not raised so high, the required capacity of the inter-cooler 27 is not as high.

Since the blower 25 is rotated at the same speed as the rotating speed of engine 11, at a time when high load is loaded to the engine 11 and requiring much output, the blower 25 is also rotated at the same high speed. Since a large quantity of air supercharged at high pressure is sucked, an effect improving the output of engine 11 can be expected.

As described above, in accordance with the present invention, an air sucking blower is provided on a cover of the clutch disc transferring the rotating power of engine to the transmission, and since the air super charged at the high pressure by the blower rotating at same high speed as the rotating engine flywheel, an engine output can be improved by a simple structure. Also, since the air is sucked through the transmission housing whereby the transmission oil and the clutch disc are cooled by the air overheating is prevented, duration of power transmitting is increased. Since sucked air does not receive any influence of the exhaust gas heat, there is also the effect that a capacity requirements for the inter-cooler.

What is claimed is:

1. In a vehicle including a diesel engine, a transmission for transmitting driving power to the wheels of the vehicle from the engine in response to the vehicle running state, and a clutch disc for transferring or isolating the power transferred to the transmission from a flywheel of the engine, a supercharger assembly for the diesel engine comprising:

a transmission housing in which a suction inlet for sucking exterior air is formed at one side of the housing, a discharge outlet for discharging the air to the engine formed at another side of the housing, and a number of power transmitting parts including the transmission and clutch disc contained within the interior thereof, a blower impeller for exhausting air at high pressure through the discharge outlet after sucking the exterior air into said transmission housing through the suction inlet, said impeller being fixed to a disc cover surrounding said clutch disc, said impeller thereby only rotating when said clutch disc rotates when said clutch disc is engaged with the engine flywheel, an air cleaner for cleaning the supercharged air discharged from said discharge outlet, and an inter-cooler for cooling the supercharged air cleaned by said air cleaner.

2. A supercharger assembly for an internal combustion engine of a vehicle including a transmission selectively coupled to a flywheel of the engine by a rotary clutch disc or engageable or disengageable with the flywheel, the improvement comprising:

a blower for supplying compressed air to the engine, said blower including a rotary impeller; and a structure for fixedly connecting the impeller to the rotary clutch disc so that the impeller rotates only when the clutch disc is engaged with the flywheel, whereby the blower does not supply the compressed air to the engine when the engine is idling and the clutch is disengaged.

3. The supercharger of claim 2 wherein the impeller comprises vanes integrally formed on a cover attached to the clutch disc.

* * * * *